US005533444A

United States Patent [19]

Parks

[11] Patent Number: 5,533,444

[45] Date of Patent: Jul. 9, 1996

[54] HIGH AIR VELOCITY CONVECTION OVEN

[75] Inventor: Thomas R. Parks, Sunnyvale, Calif.

[73] Assignee: Food and Agrosystems, Inc., Sunnyvale, Calif.

[21] Appl. No.: 385,080

[22] Filed: Feb. 7, 1995

Related U.S. Application Data

[63] Continuation of Ser. No. 178,519, Jan. 7, 1994, abandoned.

[51] Int. Cl.[6] ..... A47J 27/00; A47J 37/00

[52] U.S. Cl. ..... 99/476; 99/479; 99/447; 126/21 A; 219/400

[58] Field of Search ..... 99/447, 474, 476, 99/479, 477, 467, 473, 475; 126/21 A; 219/400

[56] References Cited

U.S. PATENT DOCUMENTS

| | | | |
|---|---|---|---|
| 2,523,786 | 9/1950 | Weeks | 219/35 |
| 3,656,469 | 1/1972 | Jung et al. | 126/21 A |
| 3,780,721 | 12/1973 | Durth | 126/21 A |
| 3,820,524 | 6/1974 | Buckell | 126/20 |
| 4,010,341 | 3/1977 | Ishammar | 219/400 |
| 4,109,636 | 8/1978 | Burge | 126/21 A |
| 4,132,216 | 1/1979 | Guibert | 126/261 |
| 4,155,294 | 5/1979 | Langhammer et al. | 99/447 |
| 4,226,178 | 10/1980 | Geissler et al. | 99/447 |
| 4,307,286 | 12/1981 | Guibert | 219/400 |
| 4,374,318 | 2/1983 | Guilliom | 219/400 |
| 4,395,233 | 7/1983 | Smith et al. | 99/447 |
| 4,484,063 | 11/1984 | Whittenburg et al. | 219/400 |
| 4,492,216 | 1/1985 | Dumont | 99/447 |
| 4,627,409 | 12/1986 | Kagomoto | 219/400 |
| 4,730,100 | 3/1988 | Pingleton | 219/400 |
| 4,928,663 | 5/1990 | Nevin et al. | 99/447 |
| 4,940,869 | 7/1990 | Scholtes et al. | 126/21 A |
| 5,107,097 | 4/1992 | Negandhi et al. | 219/400 |
| 5,165,328 | 11/1992 | Erickson et al. | 99/330 |
| 5,228,385 | 7/1993 | Friedrich et al. | 99/352 |

*Primary Examiner*—David Scherbel
*Assistant Examiner*—Reginald L. Alexander
*Attorney, Agent, or Firm*—George W. Wasson

[57] ABSTRACT

A versatile cooking unit providing food service operations with a means for rapid and uniform baking or heating a wide variety of foods. The unit comprises: a chamber (6) and blower (2), heater (3), high static pressure plenum (4), and distribution plate (5) capable of providing unidirectional, high velocity, heated air uniformly distributed through the oven chamber, and that that air velocity is maintained within desired limits during normal operation. A turntable (7) located in the oven chamber rotates vertically racked food trays or containers during operation to ensure uniform product contact with the heated air.

7 Claims, 6 Drawing Sheets

HIGH AIR VELOCITY CONVECTION OVEN

This application is a CONTINUATION of application Ser. No. 08/178,519, filed Jan. 7, 1994, now abandoned.

BACKGROUND OF THE INVENTION

This invention relates to convection ovens, more specifically to configurations, components, and air delivery systems which would increase the effective air velocity, provide more uniform food-air contact, and improve heat transfer efficiency.

BACKGROUND—DISCUSSION OF PRIOR ART

In the traditional oven, air is heated by gas burners or an electrical element, and in turn heats the food. Cooking speed and uniformity depends on air circulation within the chamber due to density differences resulting from temperature variation in the air, and the rate of heat transfer from the air to the product, a function of temperature differential and film coefficients. Because air velocities are comparatively low, film coefficients are high, and as a result, heat transfer is comparatively slow.

Convection ovens are in common use throughout the food preparation industries because of their more rapid heat transfer and improved uniformity. In these units, air is circulated by a fan or blower. Although air velocity is not high, film coefficients are significantly reduced compared with the traditional oven, and cooking time is shortened.

The patent literature describes a wide variety of forced-air oven designs as follows:

U.S. Pat. No. 2,523,796 describes a forced air system which consists of an essentially unshrouded fan mounted in the top center of the chamber, which discharges through a resistance heater to send hot air down the sides of the chamber and across to the center of the bottom, returning back to the suction port of the fan. No description is presented regarding means to prevent air short-cutting from the fan discharge directly back to the suction port without product contact. Similarly, there is no description of means to ensure uniform, positive, controlled flow of hot air to products on the various trays, or to provide uniform heat transfer. In the absence of positive means of maintaining desired flow patterns, the presence, placement, and quantity of food in the heating chamber will have a negative effect on heat transfer by disrupting flow patterns which affect recycling efficiency, and creating air resistance which reduces velocity and increases film coefficients.

U.S. Pat. No. 3,656,469 employs a back-mounted radial fan discharging past a resistance heater, along the sides, and then horizontally back through the shelves of product to the suction port of the fan. No means are described for providing effective, uniform air flow in the cooking chamber. Prior experience with sterilizers using this configuration indicate that materials along the vertical plane through the center axis can be exposed to lower temperatures than products along the sides of the chamber. Constant impingement of heated air on one side of the product will result in ununiform cooking.

U.S. Pat. No. 3,780,721 describes a back-mounted blower discharging past a resistance heater. No description or discussion is provided about how or where heated air enters the cooking chamber or means for distributing the hot air for uniform product contact. Air exiting the cooking chamber passes through a filter assembly, into a suction plenum, and then into the blower. Product is shown on stationary shelves. If the flow of heated air is consistent, and the orientation of the product is constant, some portions of the product will be more cooked than others. The fact that no positive air flow control means exist results in the condition where product placement and quantity in the cooking chamber become a controlling factor of air circulation patterns and velocity. Areas in the cooking chamber in which there is a greater product loading will have reduced air flow and consequently, reduced heat transfer rates.

U.S. Pat. No. 3,820,524 uses a fan mounted at the top-back of the chamber with ductwork to discharge air past a resistance heater and through slots into the cooking compartment which contains trays holding product. Because of a lack of effective flow control means, circulation is essentially random, with uncontrolled mixing in the compartment. The presence, location, and quantity of food will adversely affect the circulation of air in the chamber including both the recycling/reheating efficiency and velocity. These, in turn, will affect air-product heat transfer.

U.S. Pat. No. 4,010,341 represents a top-center mounted fan discharging through a resistance heater coil and down plenums at the sides of the cooking chamber. The plenums are equipped with slots which distribute portions of heated air to the various shelves. The remainder of the air continues into a bottom plenum and through holes up through the center of the cooking chamber to the suction port of the fan. In the absence of a flow control system, the presence, location, and quantity of product in the cooking will greatly impact the flow patterns, recycling efficiency, and velocity of air in the cooking chamber, and therefore the heat transfer effectiveness of this unit.

U.S. Pat. No. 4,109,636 describes a gas-fired, forced-convection oven in which the heated air passes from a plenum through a perforated plate, through the cooking chamber, and then through a second perforated plate and manifold, back to the suction port of the fan. No discussion or description addresses the relative pressure differentials across the two perforated plates, however, this is an important factor in establishing air flow and recycle efficiency, and air-product heat transfer. A second drawback to this design is the fact that product orientation and position remains constant with regard to the air flow. As a result the heated air impinges on the same place of the same containers throughout the cycle, unless the cycle is interrupted and an operator manually changes the product orientation and position. The result of constant product orientation and position relative to the hot air flow is that some portions of the product can be scorched, while others are underdone.

U.S. Pat. No. 4,132,216 relates to an oven for providing two heating zones for the reheating of refrigerated or frozen precooked foods. The use of comparatively low thermal conductivity, plastic materials such as polyethylene, severely restricts the heat transfer rates as well as the applicability of this unit for food service. The use of external ribs on the food trays restricts air flow, reducing heat transfer. Permitting heated air to by-pass the food containers reduces the thermal efficiency of this unit. The fixed position of the holes in the cartridges does not allow optimal placement as food different size food trays are used. The inability to change position of the food trays with regard to the hot air impingement during the heating cycle ensures that some portions of the food will heat up much faster than others and may become over-cooked.

U.S. Pat. No. 4,226,178 presents a hot air grill having a back-mounted centrifugal fan which discharges through a resistance heater coil and an apertured plate to create a pressure space. Heated air flows through the plate into the cooking chamber. No means or provision is described or discussed for control of the hot air circulation patterns for uniform flow or heat transfer, or to prevent short-cutting from the perforated plate directly back to the suction side of the fan. No means are provided to rotate foods in the grill chamber to ensure uniform cooking.

U.S. Pat. No. 4,307,286 describes a pulsating hot-air system for heating foods. The system includes a chamber flanked by input and output plenums, and a main flow loop in which the chamber is connected in a continuous flow path in series with an air pump drawing from the output plenum and discharging air serially through a heater section into the input plenum to create a positive pressure. The resultant pressure differential causes heated air to flow rapidly through the chamber. A secondary loop by-pass, consisting of a motorized by-pass valve connecting the input of the heater to the return line to the suction side of the air pump, by-passes the chamber, and is operated cyclically to provide a pulsatory wave. Based on the diagrams and the description, the apertured plate on the downstream side of the chamber governs the flow patterns in the chamber. This configuration, while controlling velocity during the cycles of hot air flow does not provide positive control of circulation patterns to ensure maximum velocity at the product/air interface for effective or uniform heat transfer. At higher temperature ranges, the absence of means to rotate products in the oven results in heated air continuing to impinge on the up-stream sides of the foods in the chamber causing uneven heating. The claimed benefit of interrupted hot air flows is not demonstrated or documented, and would appear unwarranted.

U.S. Pat. No. 4,374,318 presents an apparatus for heating food such as french fried potatoes in single service quantities for applications such as vending machines or domestic use. In this device, a centrally mounted fan, surrounded by a resistance heater, discharges hot air down the sides and through a small heating compartment contoured to enable high velocity air to sweep around particles providing effective heat transfer. Based on data quoted, the unit aims for air velocities of about 1800 FPM at 475°. While the small cooking compartment may achieve the heat transfer rates desired with the fan selected, this design is not suitable for the production rates needed for food service operations. If the quantities were increased, the fact that the product position relative to the heated air flow remains constant would predispose this design to unacceptable problems with ununiform heating. Despite the limitations of the specific design described, the patent contains interesting references presenting sensory scores of potatoes crisped in hot air streams of different velocities and at different temperatures.

U.S. Pat. No. 4,484,063 describes a unit with a top-mounted fan discharging past a serpentine top-mounted resistance heater and down through slots arranged in a non-symmetrical pattern around the periphery of a divider plate serving as a ceiling to the baking chamber. Hot air from the slots travels down the sides of the chamber, randomly across the chamber, and up through the product trays to the suction side of the fan. No means are discussed or described for providing positive control of hot air circulation patterns in the chamber, or movement of product to improve cooking uniformity.

U.S. Pat. No. 4,730,100 concerns a two compartment appliance with a upper compartment containing a blower and resistance heater. Heated air discharged from the top compartment is blown down a side plenum, through horizontally oriented slots across trays in the oven compartment, and through a second series of horizontal slots located at the other side of the compartment into a down-stream plenum for return to the suction side of the blower. No discussion or description is presented about the importance of air velocity to the performance of this unit, and no means are provided to rotate or change the position of foods in the oven compartment to improve cooking uniformity during the baking cycle.

U.S. Pat. No. 5,107,097 presents a forced air convection oven having a rear-mounted centrifugal fan surrounded by a resistance heater coil. Hot air discharged from the fan travels down top, bottom, and side plenums, entering the chamber to the center suction port of the fan. While no positive means are described of discussed for providing control of air circulation within the oven chamber, the unit does include a rotating turntable which turns a removable tray supporting rack to improve cooking uniformity of the product. Experience with configurations similar to this in commercial sterilization indicates a liklihood of chronic problems with ununiform heat transfer resulting in differences in product temperature, with the products in the center being cooler than the products along the sides.

U.S. Pat. No. 5,228,385 describes an convection oven sized to accommodate rolled in carts containing trays of baked goods. The oven comprises a top chamber containing a fan and heater unit and vertical plenums on both sides of the baking chamber. Heated air from the top chamber travels down both side plenums and through horizontal slots into the baking chamber, and across the food trays in the cart. Exiting the trays, the air returns through the chamber to the suction port of the fan located at the top center of the upper chamber. No discussion is presented about the importance of air velocity to the operation of this unit, and no provision is made to positively control air circulation in the chamber, or to prevent heated air from short-cutting, and returning directly to the suction side of the fan without passing through the trays at the bottom of the chamber.

Recently a number of ultra-high velocity ovens have become available to the consumer market. These units are designed for the home kitchen and claim air velocities on the order of 1000 feet per minute or greater. A well-designed representative of these units is described in detail in U.S. Pat. No. 5,165,328. This oven is approximately 16 inches in diameter, with an initial chamber height of approximately 6.5 inches, that can be expanded by means of insert kits to a height of about 13 inches. Air velocity measurements taken with the oven empty except for the basic rack corroborated the manufacturers claim of 2200 feet per minute.

The advantage of high velocity convection is in the shortened bake times required and in the lack of flavor/odor transfer between products. Experiments have shown that a dinner for two (meat, potato, and vegetable) can be cooked in 10 to 20 minutes, and that even if the vegetables include onion, and the "meat" happens to be fish, there is no discernible flavor transfer.

Because of the cyclonic pattern of air flow in the unit, the velocity was high at the periphery of the unit. The flow of air spiraled downward, across the bottom, and returned up through the center of the unit to the suction side of the fan. Air velocity measurements showed flow to be highest in the return stream. The fan generating this air flow is an unshrouded centrifugal discharging through a resistance coil which provides heat. While fans of this configuration have the capability of moving large quantities of air, their output falls off rapidly with imposition of static pressure at the discharge. Measurements of velocity in the above described unit showed that the presence of food products in the chamber caused significant change both in flow patterns and air velocity. Flow patterns were disrupted and velocity fell to approximately 40% of that observed in the empty chamber, varying with the number, size and placement of food. This reduces the heat transfer efficiency, and consequently the predictability of cook times. Despite this loss of efficiency, the unit functioned effectively for the scale of production for which it was intended.

The same design approach is used in virtually all high air velocity convection ovens on the market, and all suffer the same problem, that fan performance falls off rapidly with chamber loading.

While this loss of efficiency may be tolerable in home-scale units, it would constitute a severe problem for larger units such as would be required for commercial applications such as restaurants, delicatessens, franchise operations, and food service installations such as military bases, hospitals, retirement homes, airlines, and schools, where simplified, rapid and efficient meal preparation is essential.

OBJECTS AND ADVANTAGES

The primary objective of this invention is to provide food service operations, both earth-bound and space-related with more efficient, versatile, and faster means of baking and cooking food.

It is another objective of this invention to provide increased heat transfer rates by reducing film coefficients through the use of controlled high velocity heated air in the range of 700 to 1500 feet per minute in the oven chamber at temperatures ranging 250° to 500° F.

It is another objective of this invention to provide a configuration and high velocity heated air movement system that has sufficient static pressure capability to accommodate a wide range of product loading without significant loss of air velocity.

It is a further objective of this invention to provide convenient means for adjusting the system to accommodate a wide range of food container sizes and oven chamber loadings.

It is a still further objective of this invention to provide means for uniform contact between the high velocity heated air heat transfer medium and the food to be cooked or baked in the oven chamber.

While not essential, the interior surfaces of the oven chamber could be coated with ceramics, PTFE, or other release materials to facilitate cleanup.

Further objects and advantages of this invention will become apparent from a consideration of the drawings and ensuing description.

LIST OF REFERENCE NUMERALS

Figure 1:
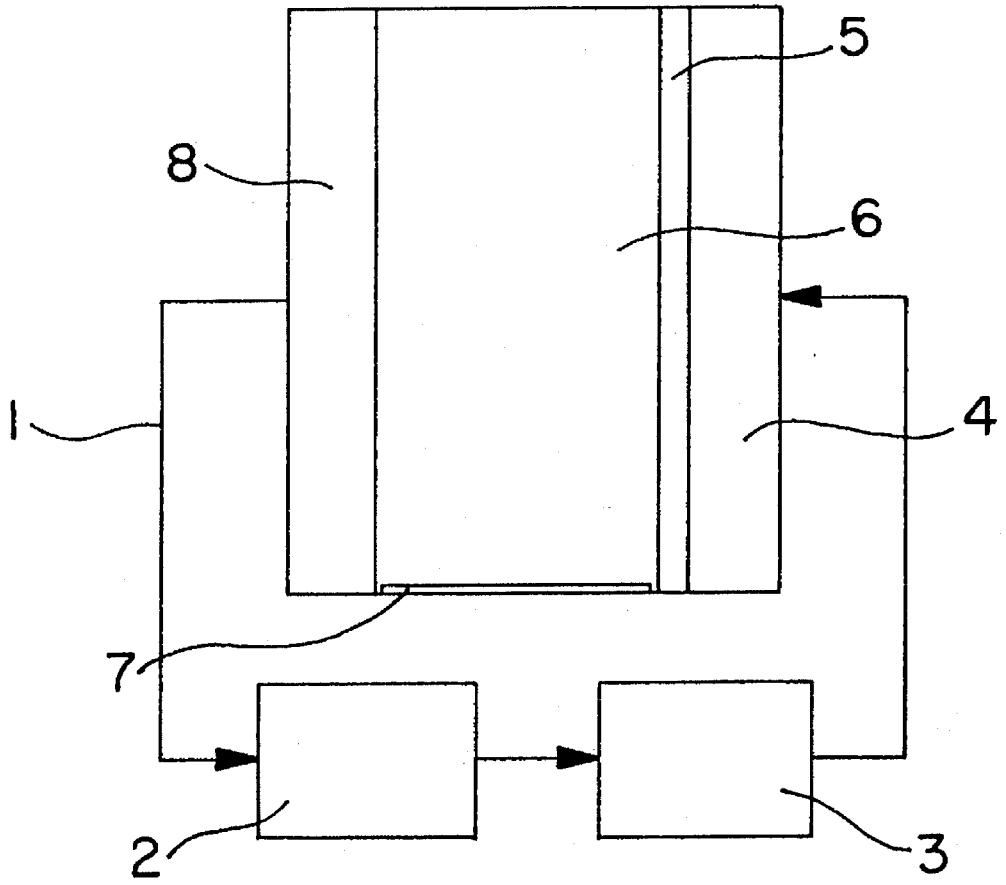
FIG. 1 shows a diagrammatic representation of the various components of a high velocity, forced-air convection oven system.

1. Air path
2. Blower
3. Heater
4. Positive pressure plenum
5. Replaceable distribution plate
6. Oven chamber
7. Turntable
8. Return air space
9. Blower-Heater-Drive compartment
10. Control
11. Access door to removable distribution plate
12. Positive pressure plenum duct
13. Baffle
14. Partition
15. Blower intake
16. Air flow path in oven chamber
17. Heater unit
18. Drive support frame
19. Blower impeller drive shaft
20. Heat sink impeller for bearing/drive protection
21. Drive motor for blower impeller
22. Drive assembly for turntable
23. Thrust bearing for turntable shaft
24. Pillowblock for turntable drive assembly
25. Drive motor for turntable
26. Hold-down cleats for product rack
27. Turntable support and drive shaft
28. Product rack base
29. Receptacle for vertical support members of product rack base
30. Rack base-mounted spring-loaded latch
31. Rack base-mounted latch cam surface
32. Turntable-mounted spring latch arm
33. Turntable-mounted beveled cam surface
34. Replaceable distribution plate with vertical slot perforation
35. Replaceable distribution plate with inclined slot perforation

DESCRIPTION OF THE INVENTION

As shown in FIG. 1, this invention for a high air velocity convection oven consists of a baking/cooking chamber in first chamber (6), a controllable fan/blower system (2) in a second chamber (9*a*), capable of providing sufficient static pressure to ensure air flow (1) through the first chamber of 700 to 1500 feet per minute during operation, a third chamber (9*b*) contains means (7) for rotating food products in the first chamber during the baking/cooking cycle and for driving the fan/blower system (2) in the second chamber. The means for rotating food products is to provide that all products are equally exposed to the heated air flow, and an air distribution system, composed of plenums (4,8) and distribution plate (5), is to provide uniform air entry into the first or cooking/baking chamber (6), and a heating system (3) in the second chamber (9*a*) capable of controllably heating the circulating air to any desired temperature in the range of 250° to 500° F., is to provide and maintain a preset temperature within desired limits in the baking/cooking chamber (6).

Many factors are addressed in this concept to provide technical feasibility. The key to achieving the desired performance and at the same time maintaining acceptable energy efficiency lies in providing uniformity in the distribution and velocity of heat transfer media contacting food in the baking chamber.

Figure 2:
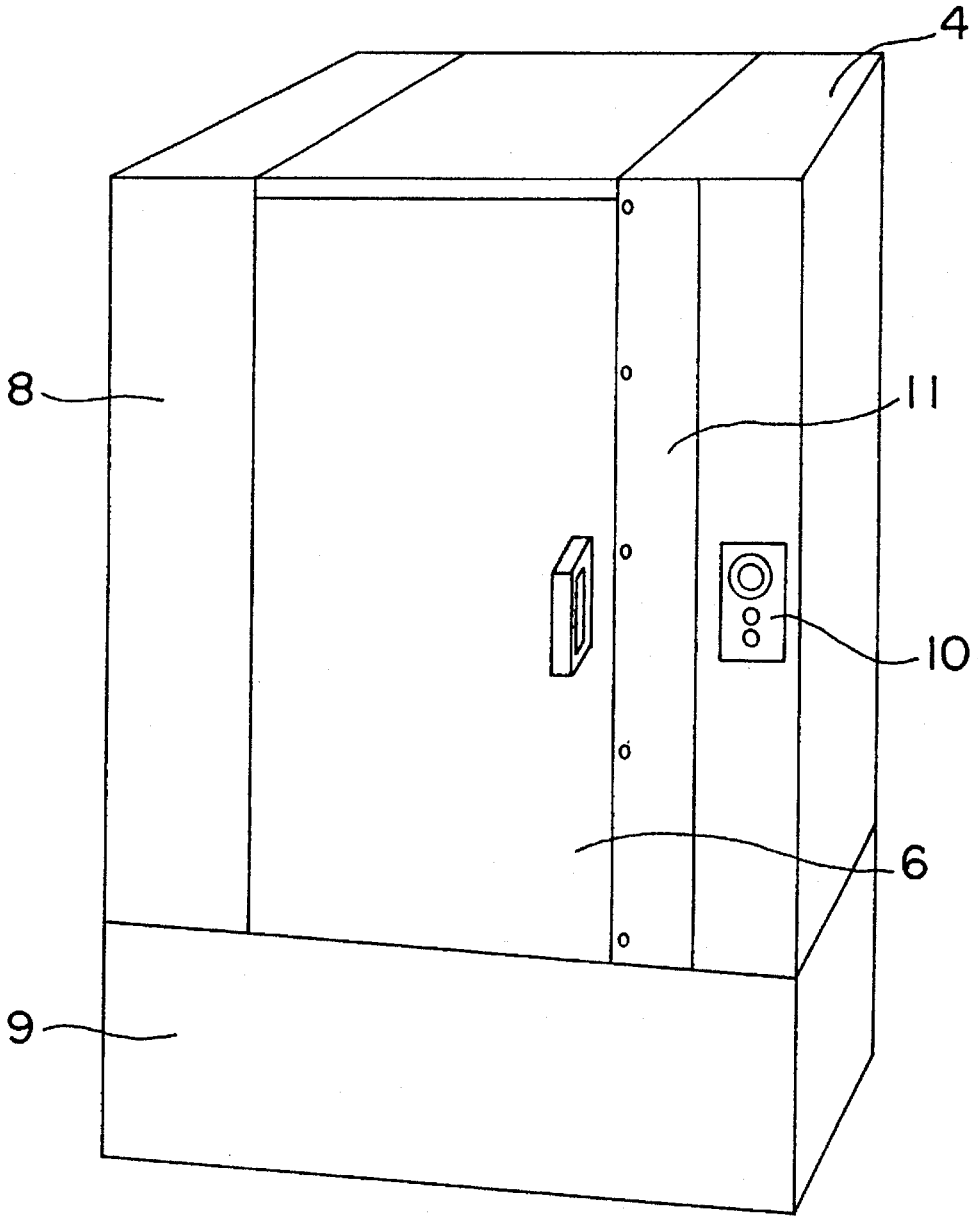
FIG. 2 shows a general configuration of a high air velocity oven concept designed to meet the objectives listed above.

FIG. 2 illustrates a general configuration. According to this configuration, a blower, heater, and turntable drive would be located in the second chamber compartments (9*a*) and a blower drive in the third chamber (9*b*) separate from a baking/cooking chamber or first chamber (6). A partial partition formed by the blower and the heater separates the first chamber (6) from the second chamber (9*a*). Positive pressure (4) and blower intake (8) plenums are located on either side of the baking/cooking chamber, with a replaceable distribution plate (5) serving as a restrictive partition between the positive pressure plenum and the chamber.

Figure 3:
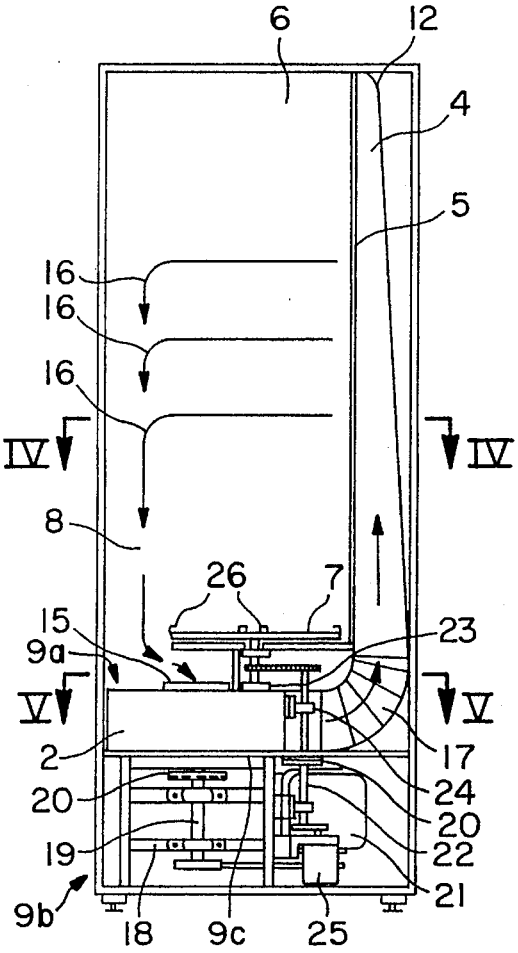
FIG. 3 shows elevation and plan-view sections of a unit such as shown in FIG. 2 indicating the various components, and the pattern of air flow.

FIG. 3 is a cutaway elevation of the configuration shown in FIG. 2. In this illustration, air (16), having passed through a baking/cooking or first chamber (6) into a blower intake plenum (8), flows into the suction port (15) of a controllable blower (2) in the second chamber (9*a*), which discharges at high velocity and elevated static pressure, through duct (17) containing resistance heater coils. Because of the need for adequate static pressure, many various types of fans used in domestic and small scale appliances may not be sufficient for this application. Heated air exits the heater duct into a positive pressure plenum (4). Separating the positive pressure plenum and baking chamber is a replaceable, perforated, distributor plate (5). This plate serves, as its name indicates, to ensure that air flows exiting the perforations of the plate are uniform. Design features involved in distributor plate performance are discussed more fully in subsequent paragraphs.

The distributor plate uses multiple perforations, preferably in the form of slots to channel heated air flowing through it into the baking/cooking chamber into individual high velocity streams which are oriented at an angle to the horizontal positioning of the food containers in the chamber. This angle may range from 5°, including, and preferably, as high 90° from horizontal. The configuration and placement of these perforations is selected to ensure that the height of the heated air streams where they contact the foods being baked/cooked substantially exceed the height of the food containers so that they do not just impinge at one position, or in a narrow band on the side of the container as could happen if the perforations were horizontally-oriented slots or holes arranged in horizontal rows. The distributor plates are conveniently replaceable so that the dimensions, number, orientation, and placement of these slots can be varied according to the size and shape of food container sizes in the oven compartment, and the spaces between the containers.

Air flow through the oven chamber during operation is a function of the size and number of perforations in the distributor plate and the static pressure differential across it. To achieve the uniformity of flow and desired heated air velocity in the chamber, it is essential that the distribution plate be selected both to provide slots of sufficient number, size, and shape for adequate flow volume to meet the velocity needs, and at the same time to maintain sufficient static pressure differential across the plate to ensure flow uniformity between the various slots. Heavy loadings in the oven chamber could result in the need to increase static pressure in the high pressure plenum upstream of the distribution plate.

The superior heat transfer uniformity objectives for this oven are achieved through three interacting attributes including: sufficient quantities of high velocity hot air at adequately high static pressures provided by the blower and heater, and uniform, properly shaped, air flows provided by distribution plate. These two factors, by themselves would provide very effective heat transfer, but focussing this heated air constantly on one portion of the food container, will result in food at the leading side of the container becoming over-cooked in order to adequately cook the down-stream side. The third major factor, and the one contributing most to achieving uniform cooking is the turntable. As illustrated in greater detail in FIG. 4, the turntable rotates the vertically racked pans in the path of the heated air so that all sides of the food containers are exposed uniformly.

Contributing to the effectiveness of the distribution plate and the turntable in providing uniform air surface contact is the fact that the chamber is designed to minimize opportunities for air to channel around the stack of food containers. This is accomplished in two ways, through designing the product tray racks with sufficient flexibility to accommodate a wide range of container sizes and configurations, while minimizing open space in the oven chamber. A second and highly important feature in maintaining adequate thermal efficiency, is the presence of baffles (13) which tend to channel air back into the stack of containers that might otherwise tend to skirt around the outside.

A blower intake plenum (8) is not a clearly defined area in that there are no dividing or restrictive partitions as in the case of the positive pressure plenum. The main function of this plenum is to collect and channel heated air (16) emerging from the vertical stack of food containers, back to the suction side of the blower (15).

To isolate them from the high heat levels required for cooking, a controllable blower drive (21) and controllable turntable drive (25) are mounted on a drive support frame(s) (18) located in one or more compartments of the third chamber (9*b*) separate from the oven and blower/heater compartments by a partition (9*c*). To dissipate heat conducted along shafts that could adversely affect bearings and belts, the blower shaft (19) is equipped with a shaft heat sink (20). This device consists of an aluminum disc with radial vanes to function as an air impeller. Because of the superior heat conductivity of aluminum, heat from the shaft tends to flow into the disc, and is transferred to air circulated by the vanes.

Depending on the size and configuration of the oven, it may not be possible to avoid placing some bearings in environments where they will be exposed to high temperature air. In the configuration shown in FIG. 3, three bearings, a flange bearing where the shaft goes through the partition (14), a thrust bearing (23), and a pillowblock (24) are shown as components of the turntable drive system (22) which would be exposed to high temperatures. Bearings exposed to these high temperatures can function adequately but require special lubricants which will not break down or char and seize-up as would normal petroleum-based lubricants. A shaft heat sink (20) to dissipate heat conducted along the turntable shaft is shown below the partition (9*c*) and at the point where the turntable shaft enters the drive compartment.

Figure 4:
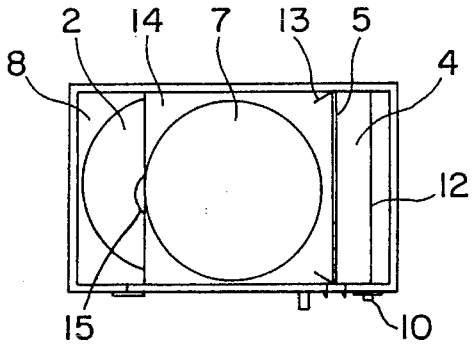
FIG. 4 shows details of a turntable design which would support and rotate food containers and trays to provide uniform contact with the high velocity heated air traversing the oven chamber.

FIG. 4 shows a turntable drive shaft (27) and a turntable (7) configuration which provides a means such as cleats (26) for positioning racks containing food to be baked or cooked in the oven. To maintain thermal efficiency, it is desirable that the food trays or containers and the rack and rack base (28) that holds them be sized according to the oven compartment (6) and turntable (7). It is possible to adjust or replace the baffles (13) described in FIG. 3 to accommodate smaller containers, however, it is preferred that insofar as possible free space between the rack and the walls of the oven chamber be minimized.

Figure 5:
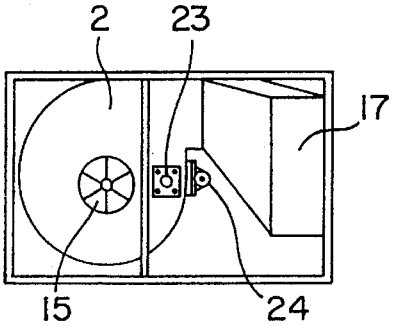
FIG. 5 describes a rack base design compatible with the turntable shown in FIG. 4. This design incorporates a means for releasably securing the rack onto the turntable so that it cannot be dislodged during the cooking/baking process by vibration or air flow.

FIG. 5 illustrates a configuration for a rack base plate (28) designed to accommodate vertical support members of a rack supporting trays or containers of food during baking or cooking. The rack base would fit under the turntable cleats (26) shown in FIG. 4. The rack base configuration shown includes a latching means such as a spring-loaded latch assembly illustrated in (detail C-C') and sections C-C' and D-D' to ensure that the rack remains securely in place during operation. As shown, a latching means would consist of a spring-loaded lever (30) mounted at the base of the cylindrical receivers for the vertical support rods of the rack. The lever would have a cam surface (31) which would ride over the cleat (26) as the rack base was pushed onto the turntable, with the catch falling behind the cleat to secure the rack when it reached the desired position. Removal after completion of the baking/cooking cycle would require only manual pressure on the upper arm of the lever (30) to disengage the catch from the cleat so the rack base could be withdrawn and removed from the turntable.

Figure 6:
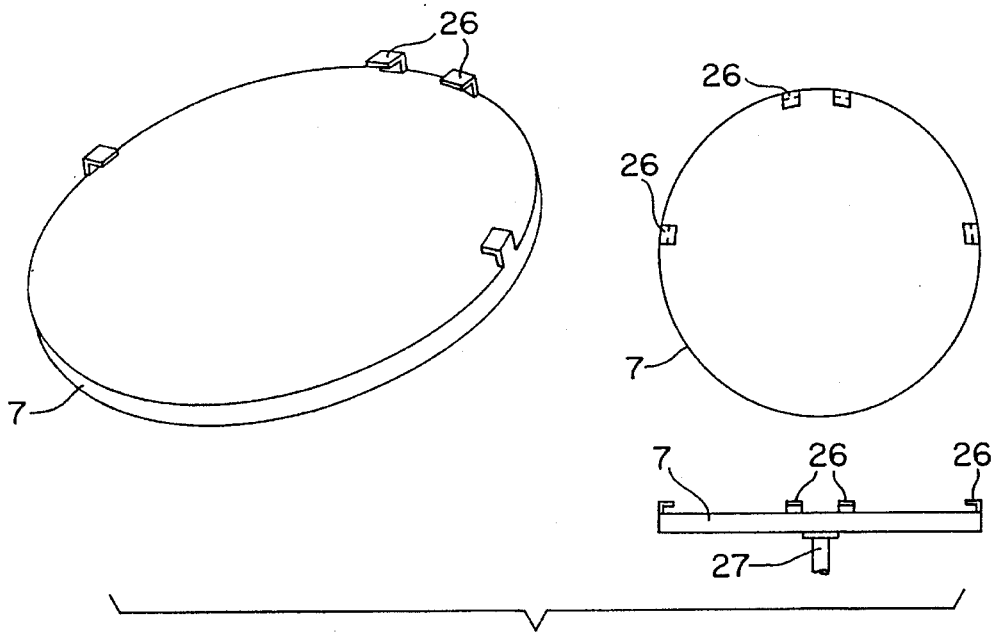
FIG. 6 shows an alternative means of releasably securing the rack base to the turntable by incorporating a latching means into the design of the turntable cleats or the turntable itself

FIG. 6 presents an alternative means of removably securing the rack base onto the turntable. This means would incorporate a spring-latch means as part of the turntable. Detail A shows such a mechanism securing a rack base (28) properly positioned on the turntable (7). In this example, the latching means is designed as an integral part of the cleat (26). Detail B shows a means of removably mounting latching cleats onto the turntable (7). Details C and D show left and right cleats (26). The spring action of the latch would be provided by the flexing of the spring arm (32) as the beveled cam surface (33) rides along the side of the rack base when the base is pushed onto the turntable. As soon as the base reaches the proper position, the catch falls behind the side projection of the rack base to secure it. Detail E shows the configuration of a rack base (28) as it would be used with the above described type of latching means. To remove the rack base on completion of the cook cycle, the two spring latches would be manually flexed sufficiently to disengage the catches, and the rack base could then be slid out from the turntable and taken from the oven.

Figure 7:
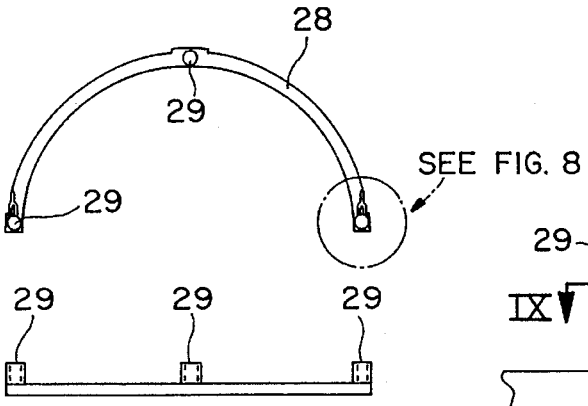
FIG. 7 shows possible distribution plate configurations.
Figure 9:
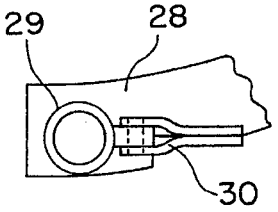
Figure 8:
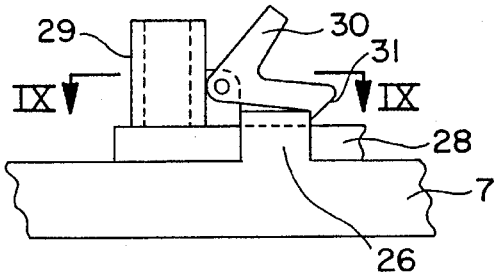
Figure 10:
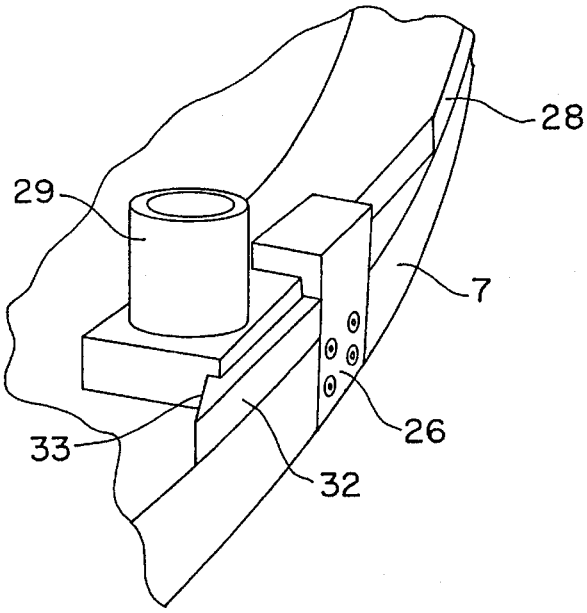
Figure 11:
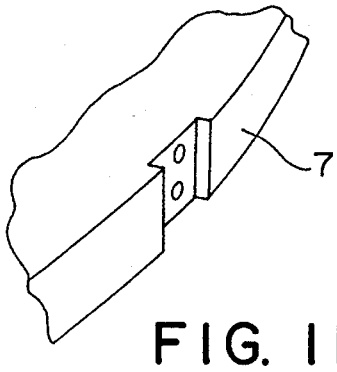
Figure 12:
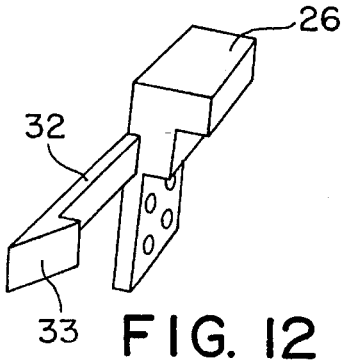
Figure 13:
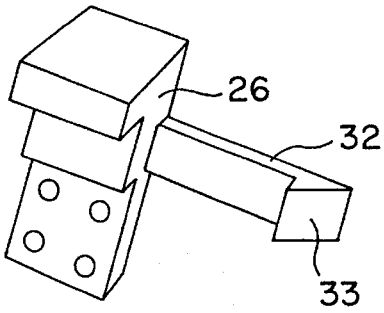
Figure 14:
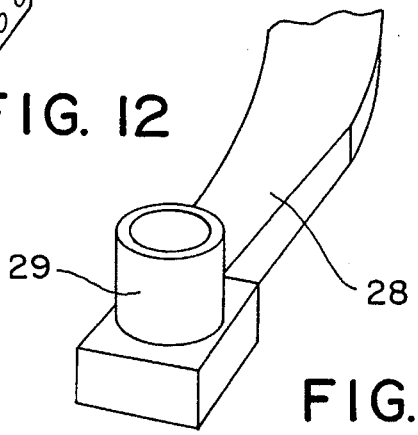
Figure 15:
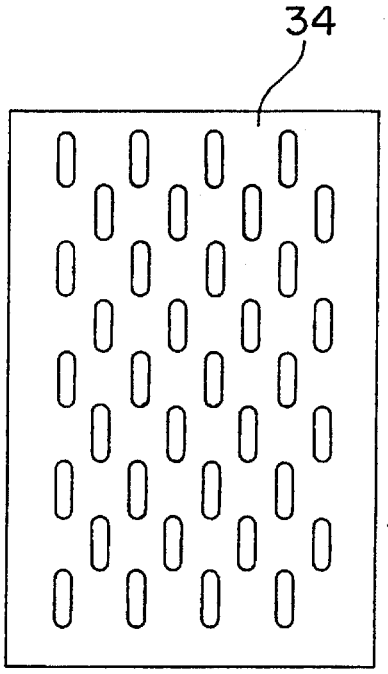
Figure 16:
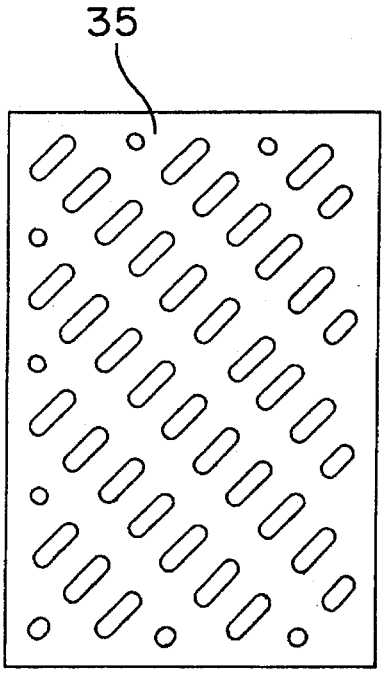

FIG. 7 shows potential configurations of the distribution plate with specific reference to the perforations. As discussed above, These perforations take the form of slots with their major axis oriented at an angle greater than 5° from the horizontal top and/or bottom surfaces of food pans in the baking/cooking oven chamber. Two configurations are illustrated in the figure, a vertical (major axis at 90°) slot (34), and an inclined slot with its major axis at 45° (35). Either configuration would function well, however, the 90° slot is preferred because it poses less difficulty with partial slots. For the purposes intended, these perforations/slots can be constructed either as square-edged orifices or as nozzles, however, square-edged orifice construction is preferred because of ease of manufacturing and potentially lower cost.

SUMMARY, RAMIFICATIONS, and SCOPE

The oven embodied in this invention enables quantities of food to be cooked/baked quickly by using heated air at high velocity to reduce film coefficients and improve heat transfer rates. To achieve uniform flow of heated air in the cooking/baking chamber, this invention employs a replaceable, perforated plate in conjunction with a positive pressure plenum to provide multiple streams of uniform, unidirectional heated air through the oven chamber. While a range of perforation configurations could suffice, the preferred configurations are slots, vertically-oriented or angled, in which the vertical height of the air streams at the point of contacting the materials on the rack, exceed the height of the food trays or pans. A driven turntable, supporting vertically stacked pans or trays of foods provides uniform air product contact.

Providing the required air quantities and velocities necessitates a controllable blower capable of providing significant static pressure and an efficient, controllable resistance or gas-fired heater.

Although the descriptions above contains many specificities, these should not be construed as limiting the scope of the invention, but as merely providing illustrations of some of the presently preferred embodiments of this invention. For example the configuration of the oven can be altered to accommodate specific product or operational requirements; the perforations of the replaceable distribution plate can be varied according to the size of food trays or pans; and the drives can be repositioned to accommodate needed changes in oven configuration.

Thus, the scope of the invention should be determined by the appended claims and their legal equivalents, rather than by the examples given.

We claim:

1. A high air velocity convection cooking oven comprising:

a) a first chamber divided into a cooking compartment and a positive pressure plenum, said first chamber being divided by a slotted air distribution plate to separate said cooking compartment from said plenum, said distribution plate being removably supported within said first chamber, said distribution plate being slotted in oriented, vertical slots for distributing air from said plenum into said cooking compartment in high velocity, uniformly distributed air streams throughout said cooking compartment, said positive pressure plenum being designed with respect to the volume of said cooking compartment to establish a static pressure between said plenum and said cooking compartment along said distribution plate resulting in uniform, unidirectional, constant flow of high velocity heated air through said slots in said distribution plate and throughout said cooking compartment, b) a second chamber adjacent to said first chamber, said second chamber having a blower unit and a heating unit, said second chamber being separated from said first chamber by a partial partition, said cooking compartment of said first chamber being connected for return air flow to said blower unit for input, said heating unit of said second chamber being connected to said plenum for supplying output high velocity heated air to said plenum, c) a third chamber containing drive means connected to said second chamber, said third chamber being separated from said second chamber by a heat insulating partition, d) and a rotatable turntable positioned in said first chamber, a motor for rotatably driving said rotatable turntable, said motor being in said third chamber, said turntable including a driven portion in the bottom of said second chamber and means extending vertically through said first chamber in the path of said uniform, unidirectional, constant flow of heated air through said slots in said distribution plate, e) whereby said blower unit is driven by said drive means to pass air from said blower unit through said heating unit into said plenum and into said cooking compartment through said distribution plate and said air passes from said cooking compartment into said blower unit, said plenum unit being designed to maintain a positive pressure throughout said plenum and so as to discharge said high velocity, uniformly distributed heated air streams throughout said cooking compartment.

2. The high air velocity oven of claim 1 in which the slots of the distributor plate are sized as a function of the differential pressure to provide a uniform, unidirectional flow of heated air in the cooking compartment at a velocity in the range of 700 to 1500 feet per minute at temperatures in the range of 250° to 500° F.

3. The high air velocity oven of claim 2 in which the slots of the distributor plate are not vertical, but uniformly angled away from vertical in the range of 5 to 90 degrees.

4. The high air velocity oven of claim 1 in which the slots of the distributor plate are constructed as nozzles uniformly-sized, oriented, and distribute over the distributor plate.

5. The high air velocity oven of claim 4 in which the nozzles of the distributor plate are not vertical, but uniformly angled away from vertical in the range of 5 to 90 degrees.

6. The high air velocity oven of claim 1 in which the heat energy provided by the heater is produced by electric resistance coils mounted in the body of the heater.

7. The high air velocity oven of claim 1 in which the heat energy provided by the heater is produced by combustion heat exchangers.

* * * * *